United States Patent [19]

Vikiö et al.

[11] 4,309,283

[45] Jan. 5, 1982

[54] HYDROCYCLONE

[75] Inventors: Pentti Vikiö; Matti Lankinen; Juhani Kyytsönen, all of Savonlinna, Finland

[73] Assignee: Enso-Gutzeit Osakeyhtio, Helsinki, Finland

[21] Appl. No.: 178,360

[22] Filed: Aug. 15, 1980

[30] Foreign Application Priority Data

Aug. 20, 1979 [FI] Finland ..... 792571

[51] Int. Cl.[3] ..... B04C 5/103; B04C 5/14

[52] U.S. Cl. ..... 209/211; 210/512.1; 55/459 R

[58] Field of Search ..... 209/211, 144, 506; 55/459 R; 210/512.1

[56] References Cited

U.S. PATENT DOCUMENTS

| | | | |
|---|---|---|---|
| 1,982,733 | 12/1934 | Forster | 209/144 X |
| 2,573,192 | 10/1951 | Fontein | 209/211 X |
| 3,887,456 | 6/1975 | Loughner | 209/211 |
| 4,153,558 | 5/1979 | Frykhult | 209/211 X |

*Primary Examiner*—Ralph J. Hill

*Attorney, Agent, or Firm*—Toren, McGeady and Stanger

[57] ABSTRACT

Hydrocyclone for dividing a fibre suspension into a lighter acceptable fraction containing fibres and a heavier reject fraction containing dirt substances. The hydrocyclone comprising a separation chamber consisting in part of a cylinder part provided with at least one passage for the tangential input of the fibre suspension to be divided into different fractions and having within itself a coaxially disposed tube for removal of the lighter fraction, and in part of a sorter cone on the extension of said cylinder part and on the apex of which has been adjoined a conical nozzle which has been made more abruptly tapering than the cone part and which at its apex has a removal aperture for the heavier fraction. On the inner surface of the sorter cone and conical nozzle has been disposed at least one guide vane running in the axial direction of the cyclone and which imparts to the heavier fraction, travelling along a spiral path on the inner surface of the sorter cone and of the conical nozzle, a radially inwardly directed component of motion. The guide vane common to both the sorter cone and the conical nozzle is located at their point of juncture.

5 Claims, 2 Drawing Figures

HYDROCYCLONE

The present invention concerns a hydrocyclone serving to divide a fibre suspension into a fibre-containing lighter acceptable fraction and a rejectable heavier fraction containing dirt substances, consisting partly of a cylindric part provided with at least one passage for tangentially introducing the fibre suspension which one wishes to divide into various fractions and within which there is a coaxially placed tube for removal of the lighter fraction, and of a sorter cone on the extension of the cylinder part, to the apex thereof having been connected a conical nozzle which has been made more abruptly tapering than the sorter cone and having on its apex a removal aperture for the heavier fraction, there having been disposed on the inner surface of the sorter cone and of the conical nozzle at least one guiding vane running axially to the cyclone and which imparts to the heavier fraction travelling along a spiralling path on the inner surface of the sorter cone and conical nozzle, a radially inwardly directed velocity component.

Hydrocyclones are extensively used in pulp and paper mills in the separation of impurities and foreign matter from fibre suspensions, these being subjected to treatment in a hydrocyclone apparatus divided into a number of stages. Each stage comprises a great number of individual hydrocyclones which have been connected together in parallel so that several hydrocyclones are simultaneously supplied from a joint chamber into which the diluted fibre suspension to be purified is pumped. In the individual hydrocyclone, the fibre suspension introduced under pressure is forced to acquire a fast rotary motion in a conically tapering tube, where under effect of centrifugal force the particles in the fibre suspension separate according to their specific gravities to form a heavier and a lighter fraction.

The heavier fraction contains the impurities having a specific gravity higher than the fibres and the occurrence of which cannot be allowed in the fibre suspension that is used in paper manufacturing. The lighter fraction, again, which is acceptable in paper manufacturing, contains mainly the fibres which have been introduced in the hydrocyclone among the suspension.

When the fibre suspension introduced in the hydrocyclone progresses in a liquid vortex towards the apex of the conically tapering tube-the sorter cone, there takes place such a separation of the fibre suspension into fractions that the heavier impurities under centrifugal force effect end up in the outer marginal areas of the vortex close to the walls of the sorter cone, whereas the fibres consituting the lighter fraction end up in the inner layer of the liquid vortex, closer to the longitudinal axis of the sorter. The impurities become concentrated in the layer adjacent to the walls of the sorter cone, and therefore the heavier fraction constituted by them is removed through the aperture on the apex of the sorter cone, as a flow of higher consistency than the incoming suspension.

Close to the apex of the sorter cone, the direction of flow of the liquid vortex is reversed to be towards the wider part of the sorter cone, and the fibres originally residing in the inner layer of the input vortex end up in this inner vortex, which is removed through a tube coaxial with reference to the sorter cone and located in the cylinder part of the hydrocyclone, where the introduction of the fibre suspension to be purified takes place. The above-described separation of the fibre suspension into a heavier fraction and a lighter fraction is not quite complete in practice, of course: the lighter fraction may entrain impurities, while on the other hand the heavier fraction may entrain fibres. In fact, the task of a well-operating hydrocyclone is to maintain a high level of purity of the lighter fraction while at the same time the fibre content of the heavier fraction must not excessively increase in view of the fibre losses incurred.

With a view to avoiding fibre losses, the procedure in each step is to supply the heavier fraction, containing impurities, which comes from the first stage of the hydrocyclone set-up and which contains fibres that should be recovered, to the next stage, wherefrom the fibres can indeed be recovered together with the lighter fraction there separated. This procedure is repeated until the fibre contents of the heavier fraction exiting from the set-up has reached the desired minimum.

Endeavours are to maintain the volumetric flow rate of the heavier fraction, that has to be discarded, in the hydrocyclone set-up at the lowest possible level, which in practice often implies that the exit aperture at the apex of the sorter cone is dimensioned to be as small as is possible without risk of plugging.

As a consequence of modern process technology, the temperature of the fibre suspensions introduced into the hydrocyclone set-ups has gone higher and higher, implying that the viscosity of the water has accordingly gone down. As a result, the water of the transport suspension tends to detach itself from the fibres and to move into the inner vortex much faster than at lower temperatures. When the consistency thus increases in the fibre suspension vortex, it is obvious that the fibres lack time to be transferred into the inner vortex: they are, instead, carried into the heavier fraction, the consistency of the latter thereby even further increasing, owing to increasing fibre content. On the other hand, dirt particles may also be carried into the inner vortex, in among the accepted fraction, by the water flowing faster owing to reduced viscosity, thereby lowering the purifying efficiency.

Certain suspensions, in particular those containing staple fibres, undergo powerful concentration in the vicinity of the heavier fraction removal aperture when endeavours are made to keep the heavier fraction volumetric flow rate low. Chances are that in such case, owing to concentration and low flow rate, the operation of the hydrocyclone may be interrupted due to clogging.

The problem thus is to provide a hydrocyclone which efficiently separates the lighter acceptable fraction and the heavier reject fraction, whereby the latter may without hindrance depart from the hydrocyclone with minimized fibre content and involving the lowest possible volumetric flow.

One solution to the problem stated has been to dilute the heavier fraction by using water jets. This however increases the volumetric flow rate of the fraction at later purification steps, in addition to which the mounting of water jets is inconvenient, particularly in so-called tank-type purifying plants.

Another solution that has been employed towards preventing the hydrocyclone from becoming clogged is that the outflow aperture of the reject fraction has been disposed eccentrically with reference to the sorter cone. This design has not proved reliable enough in service, particularly not in the case of tank-type vortex purifiers.

It is possible with the aid of the present invention to eliminate the detriments arising from the above-cited fibre losses and clogging phenomena, in the operation of a hydrocyclone.

It is possible with the aid of the hydrocyclone of the invention, which is characterized by that which has been stated in the attached claims, to considerably reduce the volumetric flow rate of the reject fraction, without increasing the clogging propensity of the purifier, and to lower the quantity of acceptable fibres therein, without causing the hydrocyclone's power of separation to go down.

DETAILED DESCRIPTION OF THE INVENTION

Figure 1:
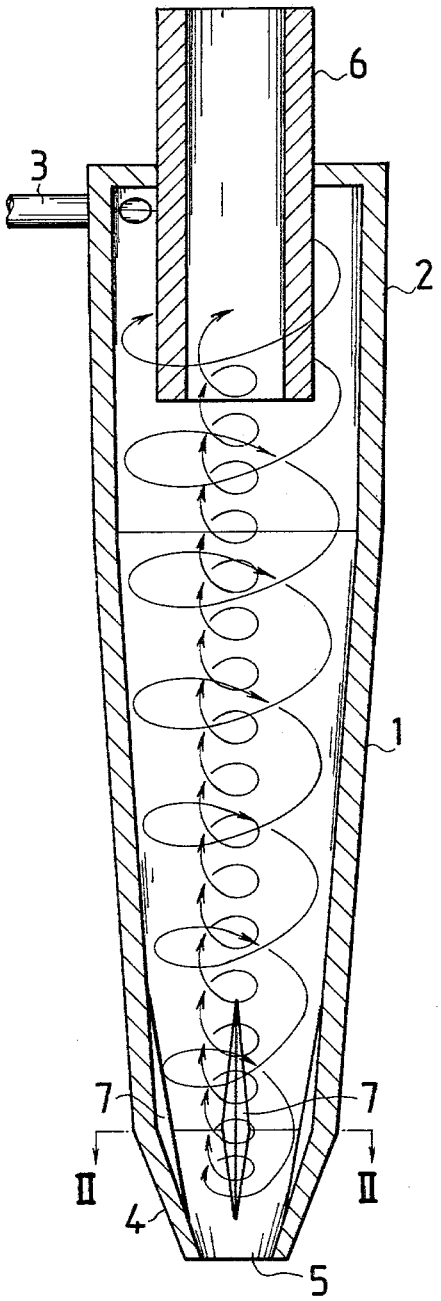
FIG. 1 is a longitudinal section of a hydroclone according to the invention.

As shown in FIG. 1, the hydrocyclone comprises a sorter cone 1, to the wider end of this cone having been conjoined a cylindrical part 2. The sorter cone 1 and cylinder part 2 constitute a housing forming the separation chamber for the pressurized fibre suspension introduced tangentially by the supply passage 3 into the cylinder part 2, and which suspension is set within the hydrocyclone into a rotary motion directed towards the apex of the sorter cone 1.

To the apex of the sorter cone 1 has been attached a conical nozzle 4 which has been made more abruptly tapering than the sorter cone 1. The conical nozzle 4 has at its apex the heavier fraction exit aperture 5, and in the cylinder part 2 has been coaxially mounted a tube 6 for removal of the lighter acceptable fraction.

Figure 2:
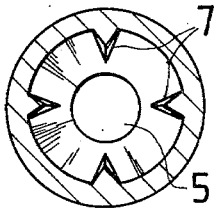
FIG. 2 is a cross section of the apparatus of FIG. 1 taken along the line II—II.

As shown in FIGS. 1 and 2, the interior surface of the sorter cone 1 and of the conical nozzle 4 carries equally spaced, four guide vanes 7 parallelling the hydrocyclone's longitudinal axis and which have triangular cross section. The height measured in the direction of the radius of the guide vanes 7 is largest at the juncture of sorter cone 1 and conical nozzle 4 and, as shown in FIG. 1, the greater part of the length of the guide vanes 7 lies on the sorter cone 1 side of the juncture of sorter cone 1 and conical nozzle 4.

In the hydrocyclone of the invention, the risk of clogging has been largely eliminated, this being based on the action of the vanes 7. As the liquid vortex travelling in the sorter cone 1 towards the exit aperture 5 reaches the guide vanes 7, it is forced to deviate from its spiral path towards the centre of the sorter cone 1. Thereby the lighter fraction in the inner layer of the liquid vortex (the fibres) comes closer to the inner vortex travelling from the apex of the sorter cone 1 towards the removal tube 6, which vortex entrains the fibres. The height of the guide vanes 7 has been so dimensioned that the travelling of the heavier fraction, on the outer edges of the liquid vortex, on its spiral path towards the exit aperture 5 is not interfered with, that is, the heavier particles pass over the guide vanes 7 and are by effect of centrifugal force once more flung to be close to the walls of the sorter cone 1. When the liquid vortex reaches the juncture of the sorter cone and the conical nozzle 4, where the flow cross section begins to constrict more rapidly, the rotational radius of the rotary motion becomes less, increasing the centrifugal force acting on the heavier fraction. Thereby the heavier dirt particles in the vicinity of the wall of the conical nozzle 4 have smaller chances than ever to be entrained in the inner vortex travelling in the opposite direction and thus to be carried in among the acceptable fraction. On the other hand, since the height dimension of the guide vanes 7 increases in the direction of movement of the inner vortex in the region of the conical nozzle 4, it is harder for a dirt particle that may have ended up on the outer margin of the inner vortex to surpass the crest of the guiding vane 7, and this dirt particle will be returned to become part of the heavier fraction close to the wall of the conical nozzle 4.

It follows that by effect of the guide vanes, the admixing of lighter fraction on the inner surface of the conical nozzle 4 to the heavier fraction, and conversely, is less than before, from which results in the former case, above all, that the concentration of the heavier fraction is less and the outflow of the heavier fraction through the exit aperture 5 is more easily accomplished.

Thanks to the conical nozzle 4, the flow velocity at the exit aperture can be increased, whereby it becomes possible to increase the differential pressure between the fibre suspension introduced into the hydrocyclone and the heavier fraction therefrom separated, which makes for greater controllability regarding the heavier fraction volumetric flow and results in higher reliability of the hydrocyclone in operation.

The invention is not confined to the embodiment in accordance with the above description and with the figures: it can be modified within the scope of the claims following below. For instance, the greater part of the length of the guide vane 7 may lie on the conical nozzle (4) side of the juncture of sorter cone 1 and conical nozzle 4.

We claim:

1. An improvement in a hydrocyclone for dividing a fibre suspension into a lighter acceptable fraction containing fibres and a heavier reject fraction containing dirt substances, said hydrocyclone comprising a housing forming a separation chamber, the housing including a cylindrical part provided with at least one inlet passage for the tangential input of the fibre suspension to be divided into different fractions and a tube for removal of the lighter fraction coaxially disposed in the cylindrical part, and a sorter cone on the extension of said cylindrical part, and a conical nozzle adjoining the apex of the sorter cone which nozzle is more abruptly tapering than the sorter cone and which at its apex has a removal aperture for the heavier fraction, there being disposed on the inner surfaces of the sorter cone and conical nozzle at least one guide vane running in the axial direction of the cyclone and imparting to the heavier fraction, travelling along a spiral path on the inner surfaces of the sorter cone and of the conical nozzle, a radially inwardly directed component of motion, wherein the improvement comprises the guide vane common to both the sorter cone and the conical nozzle extends across their point of juncture.

2. The hydrocyclone according to claim 1, characterized in that of the length of the guide vane the greater part lies on the side of the sorter cone.

3. The hydrocyclone according to claim 1, characterized in that of the length of the guide vane the greater part lies on the side of the conical nozzle.

4. The hydrocyclone according to claim 1, characterized in that measured in the direction of the radius the height dimension of the vane is maximum at the juncture of the sorter cone and the conical nozzle.

5. The hydrocyclone according to claim 1, characterized in that the guide vane has triangular cross sectional shape.

* * * * *